US006830474B2

(12) United States Patent
Liu et al.

(10) Patent No.: US 6,830,474 B2
(45) Date of Patent: Dec. 14, 2004

(54) COMMON CONNECTOR WITH EMBEDDED PINS

(75) Inventors: Wen-Tsung Liu, Taipei Hsien (TW); Chia-Li Chen, Taipei Hsien (TW)

(73) Assignee: Carry Computer Eng Co. Ltd., Taipei (TW)

( * ) Notice: Subject to any disclaimer, the term of this patent is extended or adjusted under 35 U.S.C. 154(b) by 0 days.

(21) Appl. No.: 10/223,821

(22) Filed: Aug. 16, 2002

(65) Prior Publication Data

US 2004/0033722 A1 Feb. 19, 2004

(51) Int. Cl.[7] ..... H01R 3/00
(52) U.S. Cl. ..... 439/489; 439/188; 439/630
(58) Field of Search ..... 439/630, 60, 924.1, 439/188, 632, 489, 488

(56) References Cited

U.S. PATENT DOCUMENTS 4,975,086 A * 12/1990 Reichardt et al. ..... 439/629
5,259,777 A * 11/1993 Schuder et al. ..... 439/188
5,334,827 A * 8/1994 Bleier et al. ..... 235/492
5,752,857 A * 5/1998 Knights ..... 439/638
6,015,311 A * 1/2000 Benjamin et al. ..... 439/267
6,283,376 B1 * 9/2001 Schuder et al. ..... 235/486
6,386,920 B1 * 5/2002 Sun ..... 439/630
6,399,906 B1 * 6/2002 Sato et al. ..... 200/61.59
6,402,529 B2 * 6/2002 Saito et al. ..... 439/74
6,438,638 B1 * 8/2002 Jones et al. ..... 710/301
6,468,101 B2 * 10/2002 Suzuki ..... 439/326
6,524,137 B1 * 2/2003 Liu et al. ..... 439/638
6,540,523 B1 * 4/2003 Kung et al. ..... 439/64
6,612,492 B1 * 9/2003 Yen ..... 235/451

* cited by examiner

*Primary Examiner*—P. Austin Bradley
*Assistant Examiner*—X. Chung-Trans
(74) *Attorney, Agent, or Firm*—Thomas, Kayden, Horstemeyer & Risley

(57) ABSTRACT

The present invention relates to a common connector structure, which is a die-molded close receptacle with a socket to hold and fix different types of memory cards at different times. Said receptacle comprises of a set of leaf springs at both sides of the socket to detect and control the memory card inserted in the socket. A multiple of guiding and halt-protection elements are mounted at both sides of the socket to avoid miss-insertion of the memory card. Wherein, a multiple of rows/sets of Pins of different types are embedded on the baseboard in sequence, and the Pins extrude a little bit from the receptacle at one end to contact the corresponding interface jacks of the memory card; while they rises from the baseboard vertically to at the other end.

10 Claims, 8 Drawing Sheets

COMMON CONNECTOR WITH EMBEDDED PINS

BACKGROUND OF THE INVENTION

1. Field of the Invention

The present invention relates to a common connector structure, particularly to a common signal connector with embedded pins.

2. Description of the Related Art

Currently, portable memory devices mainly include magnetic memory products, magnetic disks or optical disks utilizing optical storage technologies, and flash memory products utilizing semiconductor storage technologies. In above 3 categories, flash memory products are the most popular products in the industry, which are often called memory cards or mini-cards, such as PCMCIA ATA Flash Card(PC Card), CompactFlash Card (CF Card), Smart Media Card (SM Card), Multimedia Card (MMC Card), Memory Stick Card (MS Card), and Secure Digital Card (SD Card), etc. The popularity for flash memory cards lies in that this type of cards is far better than the other types mentioned above in portability, power consumption, data storage, data transfer rate, rewriting, shockproof, and moisture-proof features. By now, they have been widely used in consumer electronic products such as DSCs, DVRs, and PDAs as well as in new portable devices such as Smart Phones, Mobile PCs, Mobile Phones, MP3 Players, and GPS products.

With the support and leading of major flash memory card manufacturers and under the trend of rapid growth of consumer electronic products available, the growth potential of flash memory card market is vast. However, Besides inherent benefits and price advantage of portable memory products, the main influential factor to portable memory device market lies in the acceptance of consumers to the products, i.e., the sizes of connectors and the connection between memory cards and connectors have great influence to the popularization of the products in the market. In fact, portable memory devices are originally used in computer systems 'desktop or notebook', (PCMCIA interface), and subsequent consumer electronic products such as DSC and PDA (CF, SD/MMC, or MS interface). The relative high price and the inconsistent models/types of above products are a major baffle to the popularization of them.

In order to stimulate the market and the more extensive application of memory cards in terminal products and to consolidate different types of memory cards, some memory card readers capable of accessing various memory cards have appeared.

As shown in FIG. 1, an exploded view of a traditional connector, wherein the connector comprises of a top board (11) and a bottom board (12) and a baseboard (1). The baseboard (1) enables insertion of 3 different types of memory cards at different times. Top board (11) and bottom board (12) are fixed on the top surface and the bottom surface of the baseboard (1) respectively to correspond to different types of memory cards at the side against the baseboard (1). Especially, they have 4 rows of Pins which distribute on the top board (11) and bottom board (12) in turn. The Pins contact interface jacks on the memory card, which enable insertion of a multiple of types of memory cards.

The Pins are 'welded' on the top board (11) and the bottom board (12). Viewed from the point of manufacturing process and production procedures, such problems as the welding of different types of Pins and assembly of top board and bottom board both make said procedures complicated and increase the cost. Furthermore, leaf springs (43 and 44), card detection switches to detect the memory card inserted, and write protection switches (all of them are leaf springs) have to be fixed on both sides of the baseboard, which enlarge the size of such a connector. However, in today's world, large connectors are not suitable for date and information electronic products, while 'light in weight', 'thin in thickness', and 'small in size' are more appreciated.

SUMMARY OF THE INVENTION

In order to adapt to the trend of 'Light', 'Thin', 'Short', and 'Small' in portable devices, and to make the common connector comply with the standards of various memory cards, the present invention provides a die-molded and low-cost 'Common (signal) Connector', in which 3 rows/sets of Pins are embedded on a side board to enable insertion of 4 types of memory cards (SM, SD/MMC, and MS) simultaneously. Such a design not only reduces the size significantly, but also enhances the ruggedness of the device, i.e., when a memory card is inserted, the connector is more tolerant to deformation and enlarged size.

Another purpose of the present invention is to provide a device that enables SD/MMC cards only through adjusting the horizontal and vertical position of a row of Pins, on the basis of the fact that the intervals between adjacent rows of Pins are similar for SD/MMC cards and SM cards. As a result, a row of Pins in a traditional common connector can be eliminated, and there is no need to devise exclusive Pins respectively according to the interface jacks of the individual memory cards as in the traditional common connector, which reduces the possibility of miss-insertion.

BRIEF DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE EMBODIMENT

Because that the intervals between adjacent rows of Pins are similar for SD/MMC cards and SM cards, one row of Pins of a SM card can be adjusted horizontally and vertically to make the Pins adapt to SD/MMC cards simultaneously. That is to say, the 9 Pins in one of the two rows (22 Pins) of a SM card can be shared with SD/MMC card with appropriate circuit control.

Figure 1:
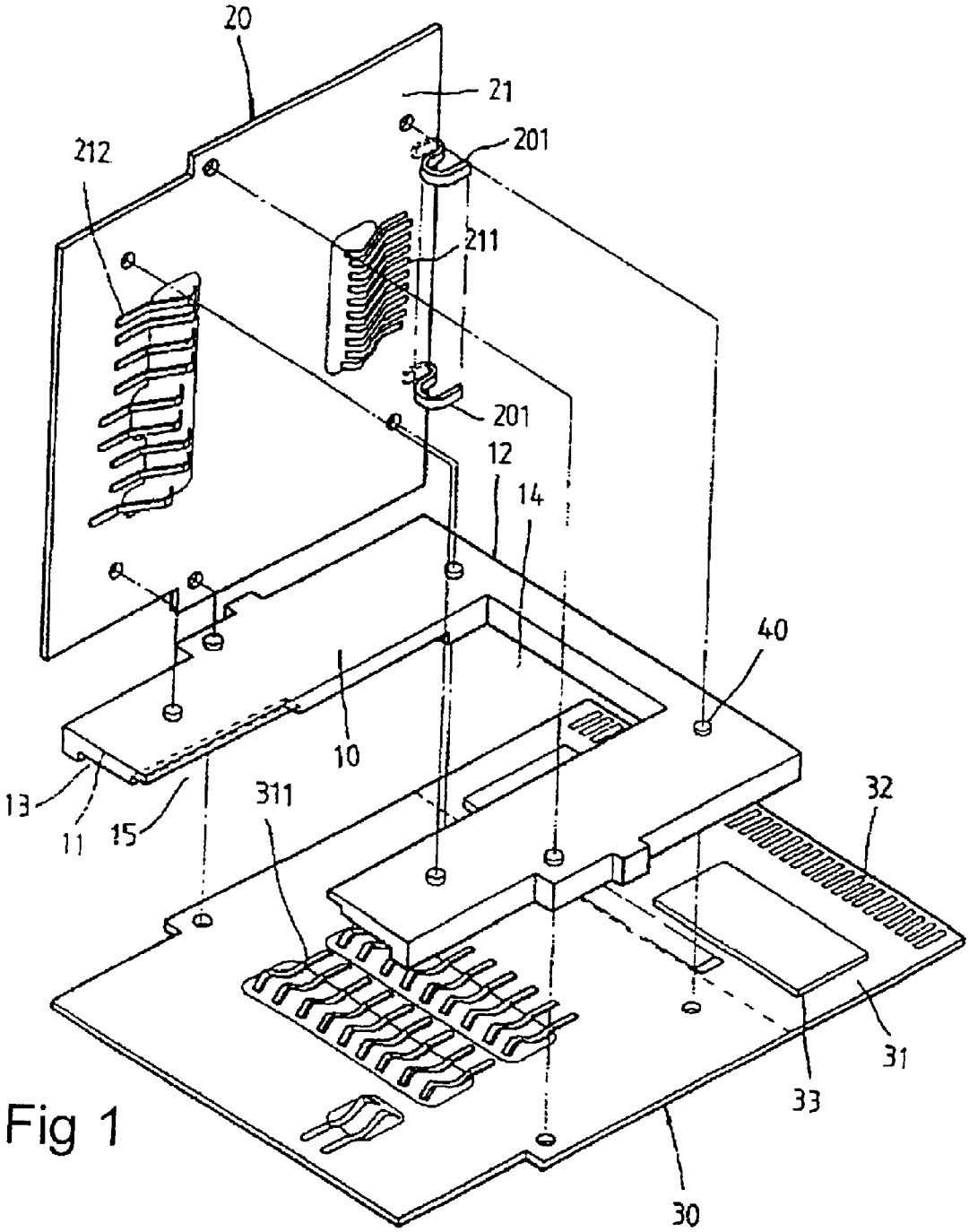
FIG. 1 is an exploded perspective view of a traditional connector.
Figure 2A:
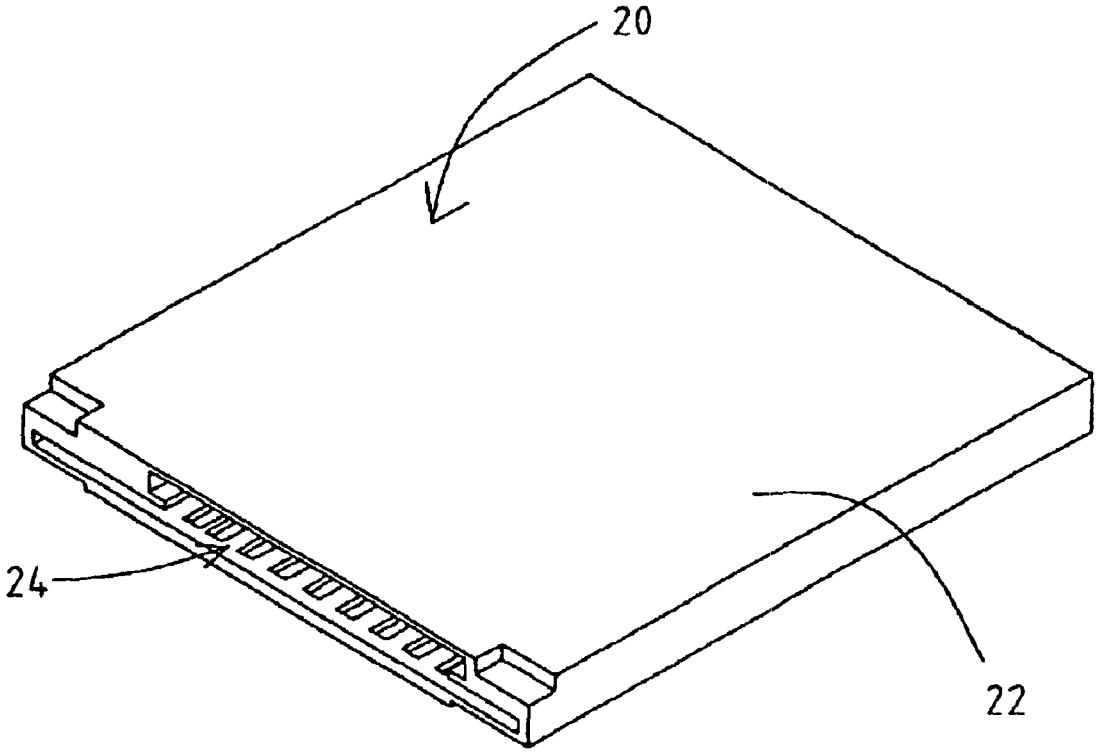
FIG. 2A is a perspective view of a common connector according to the invention illustrating the facial side thereof.
Figure 2B:
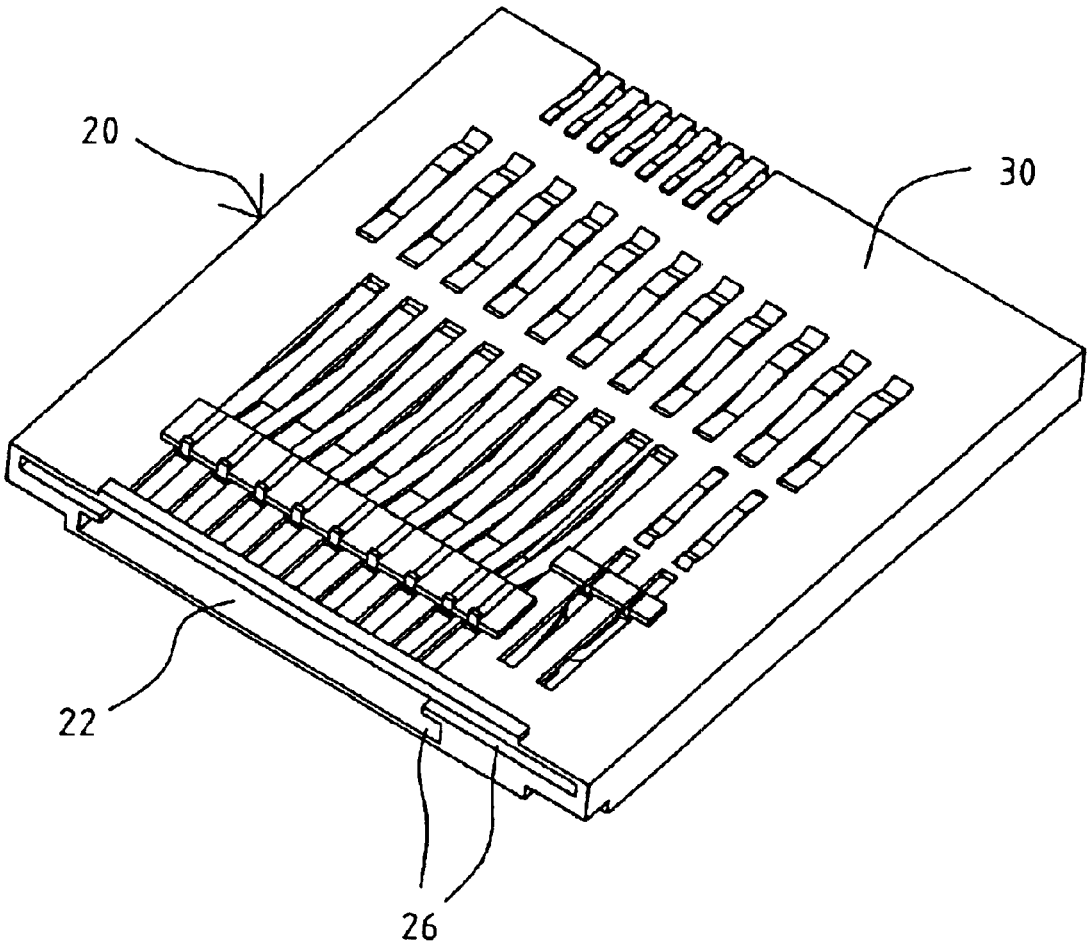
FIG. 2B is another perspective view of a common connector according to the invention illustrating the bottom thereof.

Referring to FIG. 2A and FIG. 2B, which are a front view and a top view of the common connector according to the present invention. A common connector 20 with embedded Pins according to the invention is a die-molded receptacle 22, which has a socket 24 to enable insertion of different types of memory cards at different times. The receptacle comprises:

A multiple of halt-protection and guiding units 26 at both internal sides of socket 24 to guide the insertion of a memory card and avoid miss-insertion. The halt-protection and guiding units 26 and the receptacle 22 are molded in one process with a precise mould (not shown), and said units are known and will not be discussed further here. The common connector 22 according to the invention, wherein, a multiple of rows/sets 32, 34, and 36 of Pins of different types are embedded in sequence on a baseboard 30 of the receptacle 22. Particularly, the Pins 32, 34, and 36 are fixed at right positions on the baseboard 30 with a 'planting machine' or manually directly to couple with different memory cards. There are altogether 3 rows 32, 34, and 36 of Pins.

Figure 3:
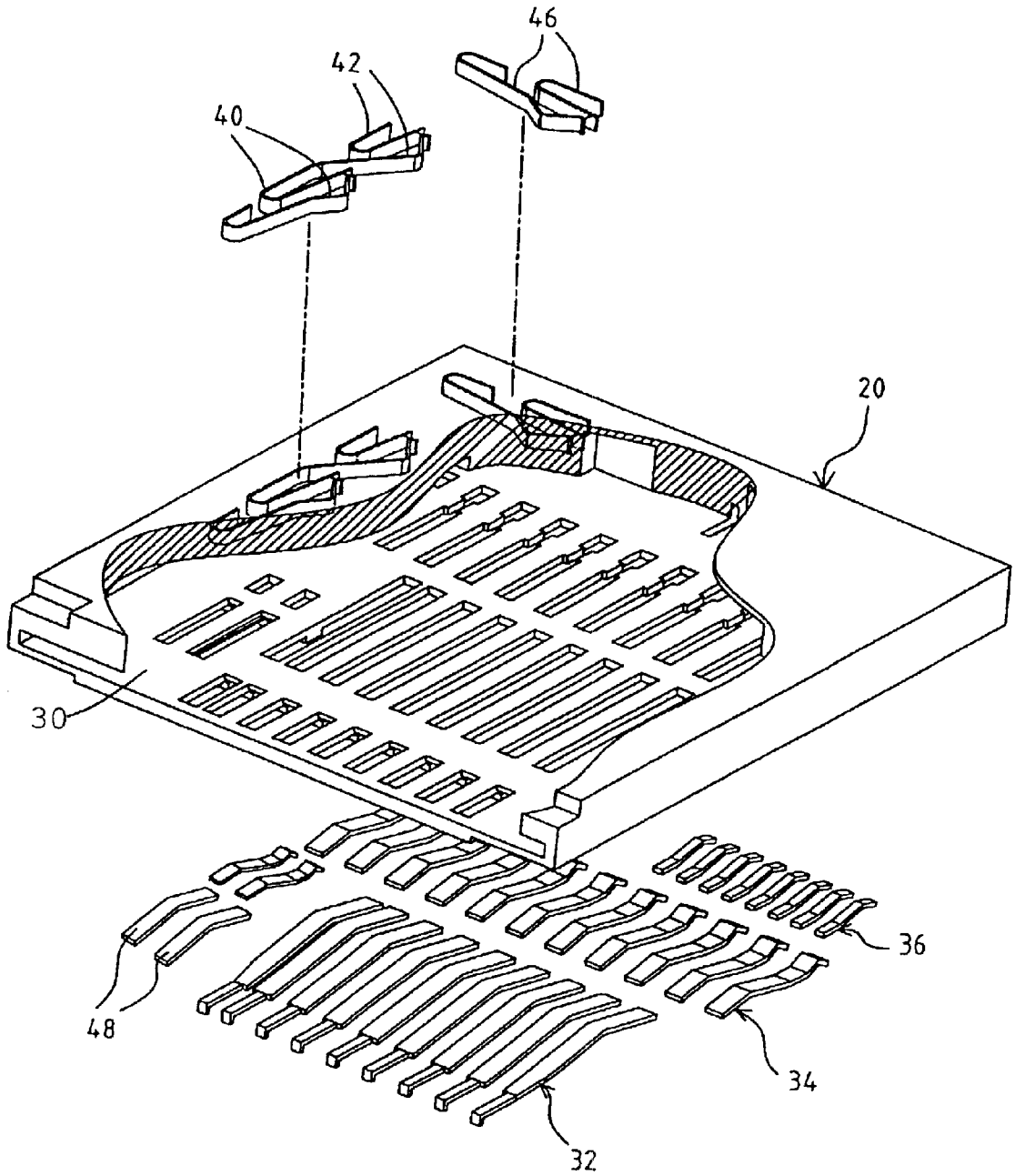
FIG. 3 is an exploded view of embedding of rows/sets of Pins into the connector according to the invention.

Also referring to FIG. 3, which is an exploded view of the embedding of rows/sets of Pins into the connector according to the present invention. The common connector 20 has a write protection switch 40 for SD/MMC cards, a card detection switch 42 for SD/MMC cards, and a card detection switch 46 for SM cards on a top of the baseboard 30. Such switches are implemented with the combination of a set of elastic leaf springs. When inserted into the socket, the memory card will contact corresponding leaf springs to form a short circuit. Then, the system can determine the input/output modes for the memory card through identifying the features of the memory card. There is a write protection switch 48 on the left side of the first row of Pins 32. If the write protection switch 48 is activated, the SM card inserted will be disabled of data transmission.

It shall be noted that the first row of Pins according to the invention can be used both for SM and SD/MMC cards. The basis for determining whether the card is SD card or MMC card depends on the detecting result of internal unique signals of the cards. The second row of Pins is used for SM cards. Besides, the third row 36 of Pins is devised to contact MS card interface jacks. Therefore, the common (signal) connector 20 enables simultaneous insertion of SM cards, SD/MMC cards, and MS cards according to the invention.

Figure 4:
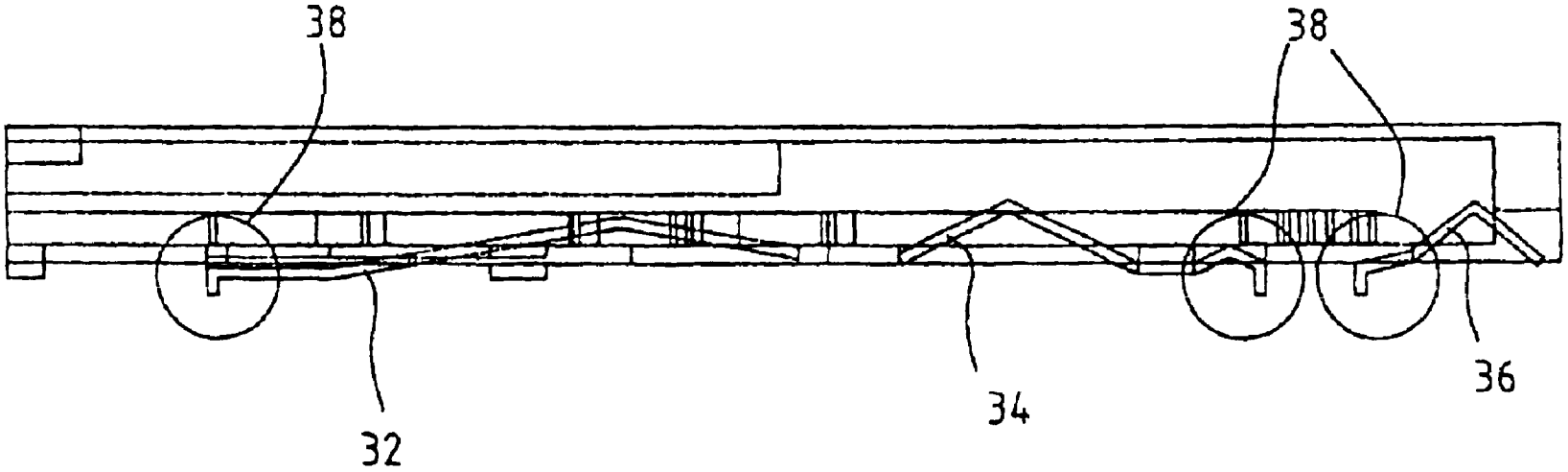
FIG. 4 is a side view of a common connector according to the invention.

Also referring to FIG. 4, which is a 3D side view of the common connector according to the invention. Apparently, it shows that the 3 rows 32, 34, and 36 of Pins respectively have a pointed potion extended from the top of the baseboard 30, and respectively have a vertical end extending from a bottom of the baseboard 30.

Figure 5:
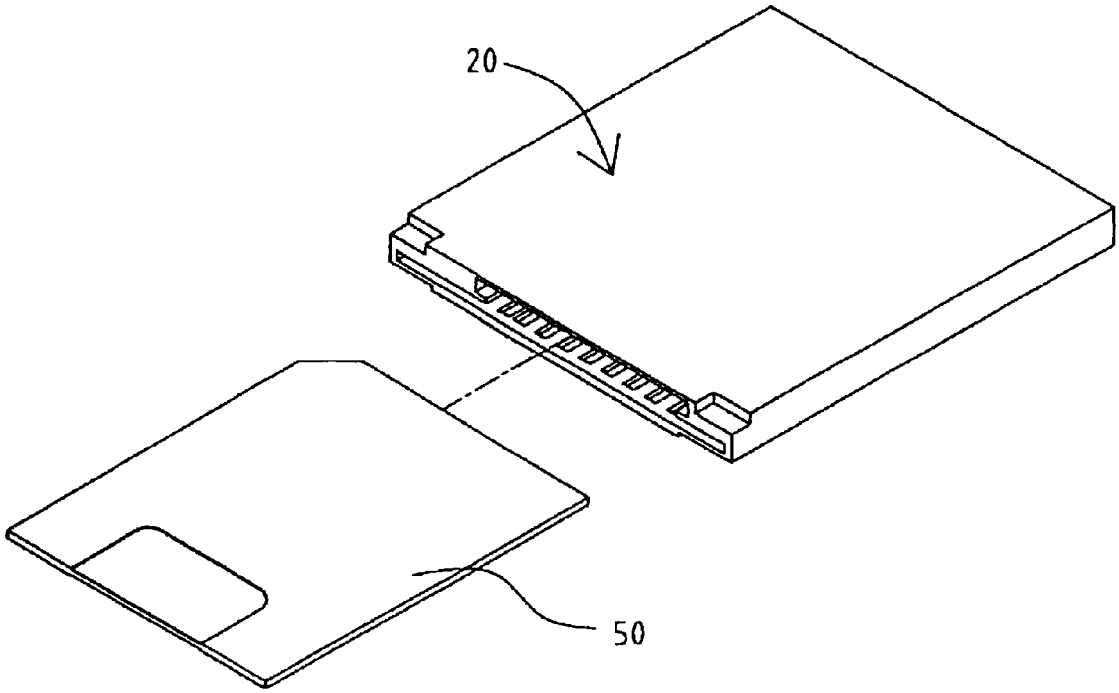
FIG. 5 is a perspective view showing a SM card being inserted in the common connector of the present invention.
Figure 6:
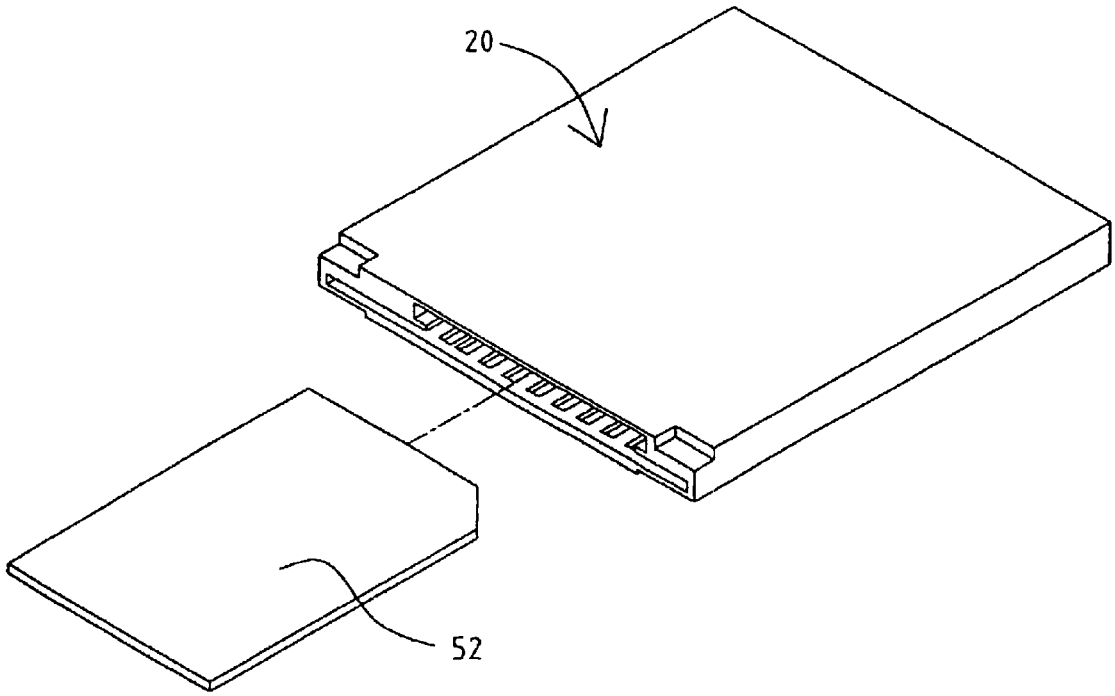
FIG. 6 is a perspective view showing a SD/MMC card being inserted in the common connector of the present invention.
Figure 7:
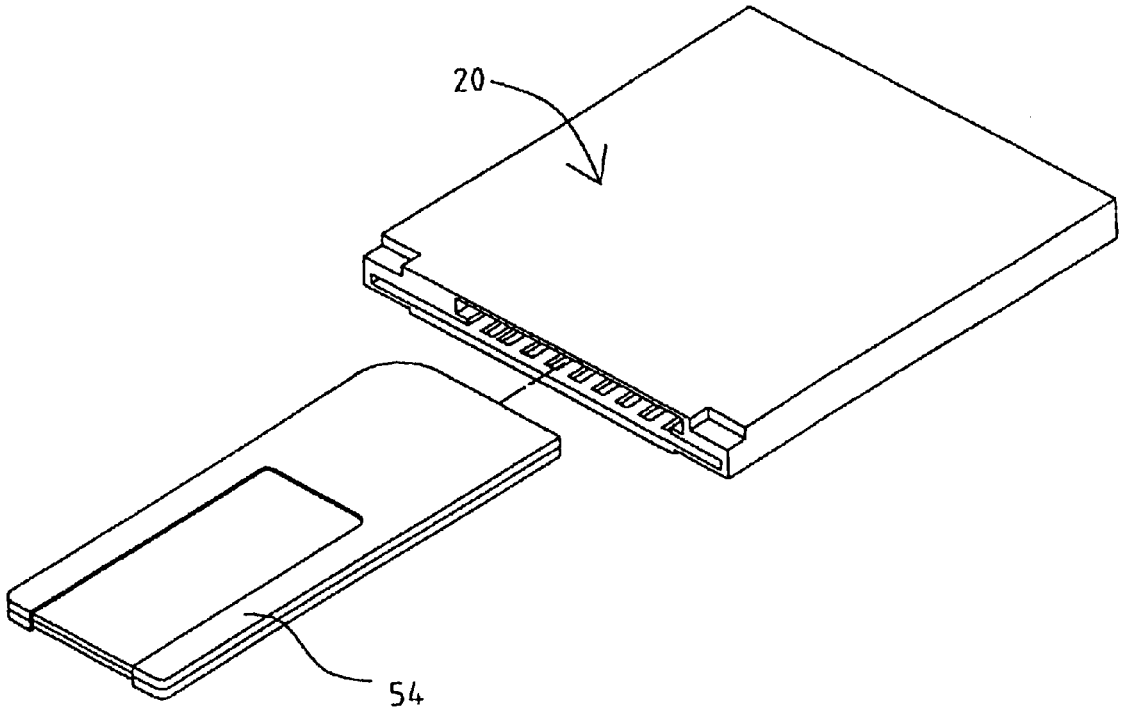
FIG. 7 is a perspective view showing a MS card being inserted in the common connector of the present invention.

Also referring to FIG. 5, FIG. 6, and FIG. 7, which show a SM card 50, a SD/MMC card 52, and a MS card 54 are inserted in the common connector according to the invention.

The present invention is innovative in structure, i.e., the SM card 50 and the SD/MMC card 52 share the first row of Pins 32 simultaneously. However, an additional electric circuit and elements are required to identify the memory card inserted in the common connector 20 and perform proper functions as selection and switching. However, the principle has beyond the scope of the present invention and will not be further discussed here.

In conclusion, the common connector with embedded Pins according to the invention has,the following benefits:

1. According to the invention, 3 rows/sets of Pins of different types are embedded on one side of the baseboard of the common connector, which enable insertion of 4 different types of memory cards, e.g., SM, SD/MMC, and MS cards. Therefore, this device not only simplifies production procedures and mechanical structure of traditional common connectors, but also decreases the manufacturing cost and enhances the quality and stability of that product.
2. According to the invention, only a row of Pins is required to be adjusted horizontally and vertically to make the Pins enable insertion of SD/MMC cards, in consideration of the fact that the the intervals between adjacent rows of Pins for SD/MMC cards and SM cards are similar. As a result, a row of Pins in a traditional common connector can be eliminated, and there is no need to devise exclusive Pins respectively according to the interface jacks of the individual memory cards as in the traditional common connector, which reduces the possibility of miss-insertion.

While the invention has been described with referencing to the preferred embodiment thereof, it is to be understood that modifications or variations may be easily made without departing from the spirit of this invention, which is defined by the appended claims.

What is claimed is:

1. A common connector with embedded pins, comprising a die-molded close receptacle; having a socket therein for receiving different types of memory cards at different times;

wherein, the receptacle further comprising:

a plurality of halt-protection and guiding units, being disposed at two internal sides of the socket to guide the insertion of a memory card and avoid miss-insertion; and a plurality of rows of pins, being embedded in one baseboard with a predetermined interval between adjacent rows of pins, wherein the rows of pins respectively have a pointed portion extruding from a top of the baseboard to contact interface jacks of the memory cards, and a vertical end extended from a bottom of the baseboard, the outmost row of pins being used for both a SM card and a SD/MMC card when only one of the SM card and the SD/MMC card can be inserted in the same socket at different times.

2. The common connector with embedded pins of claim 1, wherein three rows of pins are embedded in the baseboard and one row of pins is used to contact MS card interface jacks.

3. The common connector with embedded pins of claim 1, wherein the outmost row of pins comprises nine pins.

4. The common connector with embedded pins of claim 3, wherein a write-protection switch is further formed on a side of one row of pins.

5. The common connector with embedded pins of claim 1, wherein the connector further includes a write protection switch for SD/MMC cards, a card detection switch for SD/MMC cards, and a card detection switch for MS cards on the top of the baseboard.

6. The common connector with embedded pins of claim 5, wherein said switches are conductive elements comprising a set of leaf springs.

7. A common connector with embedded pins, comprising a die-molded close receptacle; having a socket therein for receiving different types of memory cards at different times;

wherein, the receptacle further comprising:

a plurality of rows of pins, being embedded in one baseboard with a predetermined interval between adjacent rows of pins, wherein the rows pf pins respectively have a pointed portion extruding from a top of the baseboard to contact interface jacks of the memory cards, and a vertical end extended from a bottom of the baseboard, the outmost row of pins being used for both a SM card and a SD/MMC card when only one of the SM card and the SD/MMC card can be inserted in the same socket at different times.

8. The common connector of claim 7, wherein a plurality of halt-protection and guiding units are disposed at two internal sides of the socket to guide the insertion of a memory card and avoid miss-insertion.

9. The common connector of claim 7, wherein the connector further includes a write protection switch for SD/MMC cards, a card detection switch for SD/MMC cards, and a card detection switch for MS cards on the top of the baseboard.

10. The common connector of claim 7, wherein the outmost row of pins comprises nine pins.

* * * * *